United States Patent [19]

Tichenor

[11] 3,973,413

[45] Aug. 10, 1976

[54] PORTABLE HAND KNITTING DEVICE

[76] Inventor: George Humphrey Tichenor, 545 Sutter St., San Francisco, Calif. 94108

[22] Filed: Sept. 19, 1974

[21] Appl. No.: 507,554

Related U.S. Application Data

[63] Continuation-in-part of Ser. No. 356,124, May 1, 1973, Pat. No. 3,868,834.

[30] Foreign Application Priority Data

Jan. 3, 1974 United Kingdom ..... 235/74

[52] U.S. Cl. ..... 66/1 A; 66/90

[51] Int. Cl.[2] ..... D04B 3/00

[58] Field of Search ..... 66/104, 1 R, 114, 116, 66/82 R, 119, 98, 1 A, 4, 90

[56] References Cited

UNITED STATES PATENTS

| | | | |
|---|---|---|---|
| 2,239,212 | 4/1941 | Adams | 66/1 R |
| 2,253,057 | 8/1941 | Wood | 66/4 X |
| 3,868,834 | 3/1975 | Tichenor | 66/1 A |

FOREIGN PATENTS OR APPLICATIONS

| | | | |
|---|---|---|---|
| 953,552 | 12/1965 | Germany | 66/1 R |

*Primary Examiner*—Louis K. Rimrodt
*Assistant Examiner*—Andrew M. Falik
*Attorney, Agent, or Firm*—D. Paul Weaver

[57] ABSTRACT

A knitting device has a needle bed consisting of a plurality of equidistantly spaced parallel needles and a sinker the needles being held between two depressor plates which form location points for a locking bar which in use closes the barbs of the needles when the sinker has picked up a row of stitches by movement along the needle bed so that said row of stitches can be moved to the bottom of the needles to form a row of stitches in a knitted article.

6 Claims, 11 Drawing Figures

PORTABLE HAND KNITTING DEVICE

CROSS REFERENCE TO RELATED APPLICATION

This application is a continuation-in-part of prior copending application Ser. No. 356,124, filed May 1, 1973 now U.S. Pat. No. 3,868,834.

FIELD OF THE INVENTION

This invention relates to a portable knitting device having a rotary sinker and improved needle bed.

BACKGROUND OF THE INVENTION

In my above co-pending application I described and claimed a knitting device comprising a needle bed, a plurality of equidistantly spaced substantially parallel needles in the needle bed and a sinker consisting of a shaft having a pair of opposed ends, a hook formed on one of said ends of said shaft, a bushing on said shaft in proximate relation to said hook, said bushing having a tapered leading thread, said thread having a larger root diameter adjacent the hook and a small root diameter as it approaches the other end of the shaft, whereby upon rotation of said sinker and movement of the sinker along the needle bed, working yarn or material can be sequentially drawn from between the needles.

Although the arrangement of the knitting device disclosed in my issued U.S. Pat. No. 3,868,834 is perfectly satisfactory, I have now perfected an improved needle bed which facilitates the operation of the device. The prior arrangement of my issued U.S. Pat. No. 3,868,834, as with all other prior arrangements of which I am aware, contemplates the use of metallic needles whereas with the present invention I propose using needles of plastics material. By using needles made of a flexible plastics material, adjacent pairs of needles may move apart as yarn is drawn from the gap between them and the barbs of the needles may be depressed more easily during the knitting operation. Comparable metallic needles of conventional design have minimal lateral flexibility and would require up to ten times the force to depress their barbs, thus making them unsuitable for light, hand-operated knitting devices such as specified in my present application.

Another improvement in my present needle bed is the inclusion of intermediate depressor plates at intervals which facilitate the depression of the barbs of the needles by providing fixing points for a locking bar intermediate the ends of the bed. This limits the distortion of the bed and permits a light construction.

In prior U.S. Pat. No. 2,239,212 and other simple machines descended from the metal Lee stocking frame, the needle beds' supports and locking bar are of heavy construction owing to the considerable force required to depress all the barbs of the needles at the same time and to avoid distortion of the beds. In my invention, the depressor plates and the plastic needles limit distortion to the degree that the shaft of the sinker may be used as a locking bar.

SUMMARY OF THE INVENTION

According to the present invention a knitting device comprises a needle bed, a plurality of equidistantly spaced substantially parallel barbed needles in said needle bed, at least two depressor plates one depressor plate disposed at each end of said needle bed, a retaining notch in each depressor plate and a sinker whereby on rotation and movement of the sinker along said needle bed said sinker sequentially draws working yarn or material from between the needles and on completion of a row of stitches along said needle bed the barbs of said needles may be releasably closed by locating a locking bar between said retaining notches so that said row of stitches may be passed to the bottom of said needles to form a row of stitches in a knitted article.

The invention also includes a knitting device comprising a sinker and a needle bed formed of a plurality of plastics, or other resilient material, barbed needles releasably secured together between two depressor plates by at least one retaining bar, the sinker in use being adapted on rotation to sequentially draw working yarn from between the needles and on completion of the loops of a row being moved to a retaining position between the depressor plates in which the barbs of the needles are held closed allowing the yarn to be moved over the needles.

BRIEF DESCRIPTION OF THE DRAWINGS

The invention will now be described by way of example with reference to the accompanying drawings in which.

FIGS. *7a* and *7b* are views from opposite sides of an alternative sinker having a varying leading thread.

DESCRIPTION OF THE PREFERRED EMBODIMENTS

Figure 2:
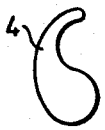
FIG. 2 is an end view of the sinker of FIG. 1.

In the drawings a knitting device comprises a sinker 1 and a plurality of needles 2 connected together by two retaining bars 3 to form a needle bed. The sinker 1 is formed with a hook 4, a neck 5 and a shaft 6. The hook 4 is arcuately curved about the longitudinal axis of the sinker as clearly seen from FIG. 2 and adjoins the neck 5 which is of larger diameter than the shaft 6: preferably the hook 4 and neck 5 are formed as an integral plastics moulding which fits over the end of the shaft 6 which is preferably made of a metallic material. The neck 5 has a tapered leading thread from a larger root diameter adjacent the hook 4 to a smaller diameter adjacent the shaft 6 in use to propel the sinker forward. The shaft 6 of the sinker 1 serves to transmit rotary motion to the hook and to retain the loops formed. It is of reduced diameter in order to minimise friction and is lightly splined as at 7 to make it easier to twirl between the fingers; the shaft 6 extends the length of the needle bed.

Figure 3:
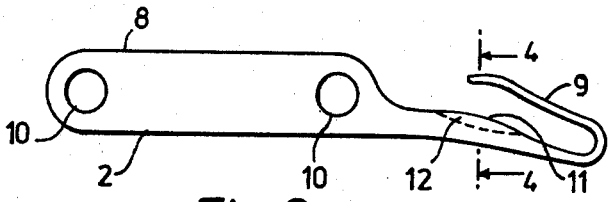
FIG. 3 is a side view of a needle.
Figure 4:
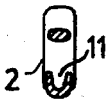
FIG. 4 is a sectional view on 4—4 of FIG. 3.

The needles 2 are each made of moulded plastics material, preferably nylon, and have a base 8 and a barb 9. The base 8 of a needle 2 has two holes 10 through which retaining bars 3 pass and a recess 11. Referring particularly to FIG. 3 it will be seen that the base 8 is formed with a slight bend 12, below the barb 9, within which the recess 11 is formed.

At each end of the needle bar, a depressor plate 13 is located. If a large needle bed is employed, then one or more additional intermediate depressor plates 26 are situated at thirty to fifty needle intervals. Plate 13 has a body portion 14 formed with two holes 15 corresponding to holes 10 and an extension portion 16. The extension portion 16 lies adjacent the barbs 9 of the needles 2 and has a notch 17 and a rebate 18 formed in its underside as viewed in FIGS. 5 and 6.

Figure 5:
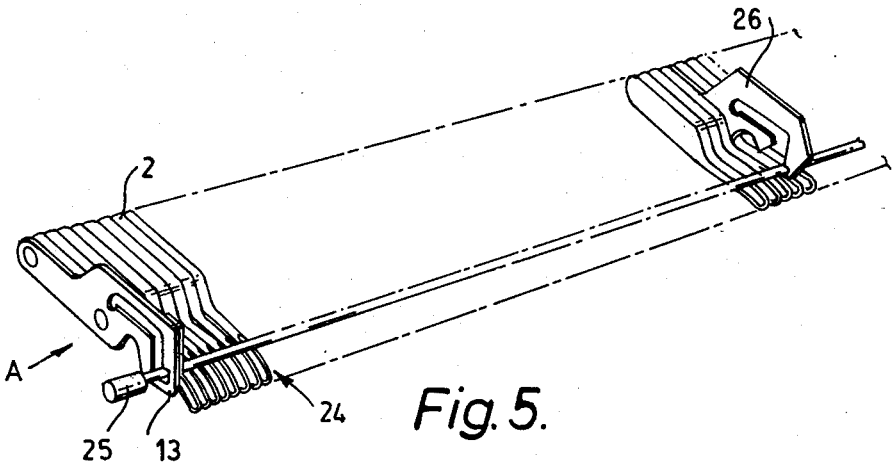
FIG. 5 is a broken away perspective view of the device in use.
Figure 6:
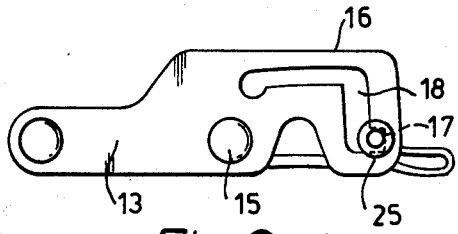
FIG. 6 is an end view in the direction of arrow A of FIG. 5.

As seen from FIGS. 5 and 6 the end depressor plate 13 and the intermediate depressor plate 26 are similar. Plate 26 differs slightly from plate 13 in that rebate 18 is closed in the end depressor plate to retain a depressor bar 25.

Figure 7A:
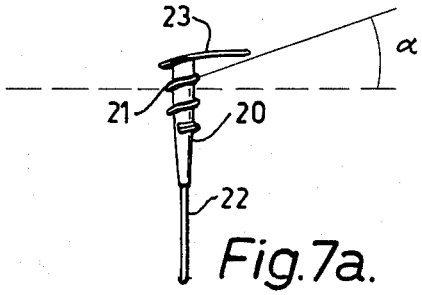
Figure 7B:
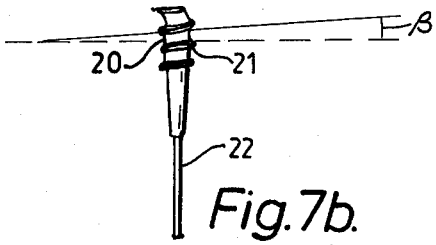

FIGS. 7*a* and 7*b* illustrate an alternative sinker 20 in which the angle of the leading threads 21 relative to the axis of shaft 22 is not constant, as in an ordinary screw-thread, but varies around the circumference in such a way that, for every rotation of the shaft, there is a pause in the movement of the head of the sinker in the axial direction along the bed during that part of rotation when the hooked portion is engaged in the needle bed 24, and a compensatingly large movement of the head of the sinker in the axial direction along the bed when the hook has rotated free from engagement with the needle bed. That is, the threads 21 may be at right angles to the shaft 22 on the hook side and at a steep angle on the other. The variation in the angle of the thread about the circumference of the sinker allows the hook 23 to move past the points of the needles and through the gaps between the needles at approximately a right angle to the plane of the bed 24. This refinement tends to reduce rubbing and the possibility of snubbing the yarn between the hook 23 and the end of a needle as the yarn feeds into a new loop.

Figure 8:
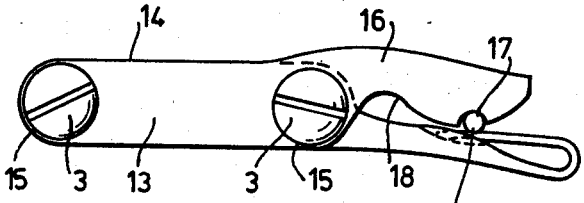
FIG. 8 illustrates an alternative form of depressor plate in side elevation.

FIG. 8 shows an alternative form of depressor plate 13 for use particularly when the shaft of the sinker is being used as a depressor bar.

In operation the needles 2 are secured together by passing retaining bars 3 through holes 10 of the needles and holes 15 of the depressor plates 13 and tightening a nut fixture on one end of each bar 3. The first row of stitches is done without the aid of a sinker in the following manner: a slipknot is made over the first needle in the row and the working yarn is wound over the thickened portions of each needle (i.e. the hooks) in the form of a loop. The loops are then pushed towards the bases 8 of the needles to form a loose ruffle. The free end of the yarn (which now extends from the end of the needle bed remote from the end having the slipknot) is then slid under the plates 13 and over the barbs 9 of the needles in such a way as to bring it around under the barbs and into the needle hooks.

Figure 1:
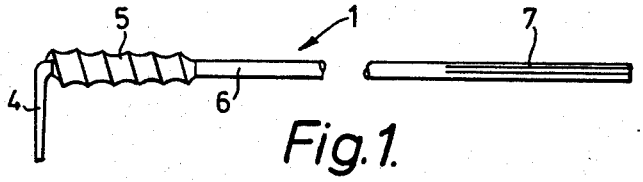
FIG. 1 is a side view of one suitable sinker.

Following this operation the slack in the yarn at the point where it joins the previous row is taken up. The sinker is then taken in the operator's hand and the hook 4 placed in the space between the first and second needles of the row so as to engage the newly loaded yarn. The sinker, after it has picked up the first one or two stitches, is then grasped lightly at its far end and rotated between the fingers. Referring particularly to FIG. 1 the completed loops are formed around the leader threads which allow the loops to slacken somewhat after they are formed due to the taper so that friction is reduced.

Figure 9:
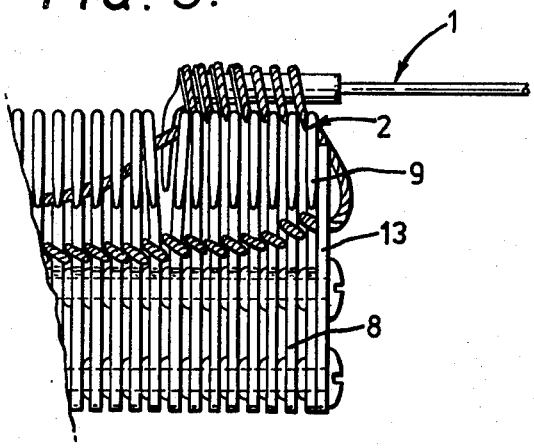
FIG. 9 is a broken-away plan view of the needle bed showing a sinker picking up yarn from between plastic needles.
Figure 10:
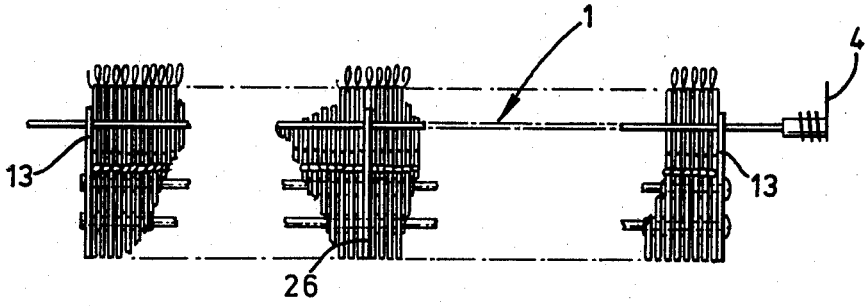
FIG. 10 is a plan view of a needle bed in which the barbs of the needles have been closed by the shaft of the sinker.

Referring now particularly to a device with depressor plates as shown in FIGS. 8, 9 and 10, after all the loops have been formed by rotating the sinker as illustrated in FIG. 9, the shaft 6 of the sinker is pushed over the barbs 9 of the needles and under the extension portion 16 of the plates 13 so that the shaft becomes located between the notches 17 and closes the barbs 9. When a large needle bed is used as shown in FIG. 10, the shaft 6 of the sinker is also located in notches (not shown), similar to the notches 17, in the intermediate depressor plate 26. The old loops already at the base of the plastic needles are then pulled over the closed barbs, the shaft of the sinker 6 removed and then the old loops pulled over the new loops just formed so that the new loops become linked with the old loops. The material is then pulled down onto the shanks of the needles so that the new loops are passed beneath the points of the needle barbs. The device is then reloaded as described above except from the other end of the needle bed.

Referring now to FIGS. 5 and 6, an alternative to using the shaft of the sinker to close the barbs of the needles is to provide a separate depressor bar 25. In this case, after the loops have been formed on the needles, the bar 25 is pushed with the thumbs away from the bases of the needles and, guided by rebate 18, comes to rest on the barbs 9 of the needles. Forcing the bar 25 into notches 17 then forces the barbs 9 into the needle recesses 11 whereupon the old loops may be pulled over the new ones as before.

A needle 2 itself has several distinct advantages over a conventional needle e.g.

i. the needles are made of a flexible plastics material preferably nylon which allows the needles to flex sideways as shown in FIG. 9 and to be placed somewhat closer together than would be the case if the needles were rigid. If rigid needles were used, sufficient gaps between each needle would have to be provided to allow the yarn to be drawn from between the needles by the hook 4 of the sinker and thus a bed using rigid needles would be longer than the bed using the same number of plastic needles.

ii. the needles have a bend opposite the barbs which has two purposes:

a. during the twirling operation, when the yarn is travelling into the needle bed, it flows up the bed by the base and therefore the yarn stays fairly close to the shafts of the needles and away from the points of the barbs which would otherwise have a tendency to foul it.

b. during the fabric pulling-off operation, the force of the finished material on the downward projecting tips of the needles tends to push the needles upwardly slightly against the shaft of the sinker (or the depressor bar). Therefore the bend closes any of the barbs which might be open a little too far.

iii. The flexibility afforded by plastics materials allows the barbs 9 to be depressed with very little force and thereby permits the shaft 6 of sinker 1 to be used in place of the heavy presser bar usually found in knitting devices of this type.

What is claimed is:

1. A knitting device comprising a needle bed, a plurality of equidistantly spaced substantially paralled barbed needles in said needle bed, a depressor bar for closing the barbs of the needles in said needle bed, at least two depressor plates one depressor plate disposed at each end of said needle bed, a retaining notch in each depressor plate and a sinker whereby on rotation and movement of the sinker along said needle bed said sinker sequentially draws working yarn or material from between the needles and on completion of a row of stitches along said needle bed the barbs of said needles may be releasably closed by locating the depressor bar between said retaining notches so that said row of stitches may be passed to the bottom of said needles to form a row of stitches in a knitted article.

2. A knitting device according to claim 1 wherein the needles are of a flexible plastics material.

3. A knitting device according to claim 1 wherein the sinker consists of a shaft having a pair of opposed ends, a hook formed on one of said ends of said shaft, a bushing on said shaft in proximate relation to said hook, said bushing having a tapered leading thread, said thread having a larger root diameter adjacent said hook and a smaller root diameter as it approaches the other end of said shaft.

4. A knitting device according to claim 3 wherein the angle of the threads relative to the axis of the shaft of said sinker varies around the circumference.

5. A knitting device according to claim 1 wherein further depressor plates are disposed intermediate the two ends of said needle bed.

6. A knitting device comprising a sinker, a needle bed formed of a plurality of plastics barbed needles, two depressor plates one disposed at each end of said needle bed, a retaining bar securing said plastics needles and said depressor plates together and a retaining notch in each of the said depressor plates, the said sinker having a shaft which forms a depressor bar which sinker in use is adapted on rotation and movement along said needle bed to sequentially draw working yarn from between the said plastics needles and on completion of the loops of a row the shaft forming the depressor bar is moved to a retaining position within the said notches and extending between the said depressor plates in which the barbs of the said needles are held closed allowing the yarn to be moved over the plastics needles.

* * * * *